United States Patent [19]

Spedding

[11] 3,955,821

[45] May 11, 1976

[54] GOLFER'S STANCE TRAINING DEVICE

[76] Inventor: Oliver T. Spedding, P.O. Box 95, West, Krugersdorp 1742, South Africa

[22] Filed: Aug. 27, 1974

[21] Appl. No.: 500,879

[30] Foreign Application Priority Data

Aug. 31, 1973 South Africa ..... 73/2591

[52] U.S. Cl. ..... 273/187 B; 273/188 A

[51] Int. Cl.[2] ..... A63B 69/36

[58] Field of Search ..... 273/187, 195, 188, 183, 273/32 E, 189, 190

[56] References Cited

UNITED STATES PATENTS

| | | | |
|---|---|---|---|
| 2,189,613 | 2/1940 | Paulsen | 273/188 A |
| 2,847,769 | 8/1958 | Schlesinger | 273/188 A |
| 3,363,903 | 1/1968 | O'Brien | 273/187 B |
| 3,639,923 | 2/1972 | Stewart | 273/187 R |

*Primary Examiner*—George J. Marlo

*Attorney, Agent, or Firm*—Stevens, Davis, Miller & Mosher

[57] ABSTRACT

Apparatus for use in training golfers including two foot rests on which the golfer places his feet when addressing a golf ball during play of a stroke, the foot rest intended for the left foot, in the case of right handed golfers, or the foot rest intended for the right foot, in the case of left handed golfers being adapted to rock on a retaining structure from a substantially horizontal position to a position in which its foot supporting surface faces outwards relative to the other foot rest. The retaining structure holds a leg rest near the other foot rest to bear against an outside portion of a leg of a golfer during training of the golfer. A rod supports the rockable foot rest and includes spigot formations on each end which fit in complementary shaped formations on the retaining structure to provide different spaced apart positions between the two foot rests.

9 Claims, 6 Drawing Figures

GOLFER'S STANCE TRAINING DEVICE

FIELD OF THE INVENTION

This invention is concerned with apparatus adapted for use in the training of golfers.

BACKGROUND OF THE INVENTION

In order to reach proficiency, it is essential that the various strokes, comprising the game of golf, be mastered. This entails not only addressing the ball correctly and co-ordinating the various body movements while playing a stroke, but adopting the correct stance during various stages of playing the stroke.

An object of the present invention is the provision of apparatus adapted for use in assisting a golfer to acquire these correct body movements and stance when playing the ball.

SUMMARY OF INVENTION

According to the invention, apparatus adapted for use in the training of golfers includes a retaining structure, first and second foot rests adapted to be held by the retaining structure in a spaced apart arrangement, each foot rest having a foot supporting surface, the first foot rest being adapted to rock, in an operative position of the apparatus, between one extreme position in which its foot supporting surface is substantially horizontal, i.e., parallel to the plane containing the foot rests and another extreme position in which its foot supporting surface is inclined to such plane and faces outwardly relative to the second foot rest.

In one form of the invention, the second foot rest is held against movement by the retaining structure. In this case, the foot supporting surface is inclined to the horizontal, i. e., the plane containing the foot rests and faces inwardly relative to the first foot rest.

In another form of the invention, the second foot rest is adapted to rock between one extreme position in which its foot supporting surface is substantially parallel to the plane containing the foot rests and another extreme position in which its foot supporting surface is inclined to such plane and faces inwardly relative to the second foot rest. In this form of the invention, the second foot rest is adapted to rock about an axis extending in a toe-to-heel direction across the foot rest. The second foot rest may include spigot formations adapted to engage the retaining structure for relative rotational movement about an axis extending in a toe-to-heel direction over the foot rest.

Preferably the first foot rest is adapted to rock about an axis extending in a toe-to-heel direction over the foot rest. Spigot formations may be provided on the foot rest which are adapted to engage the retaining structure for relative rotational movement about an axis extending in a toe-to-heel direction over the foot rest.

Further according to the invention, the retaining structure includes an open frame with two opposed sides having a plurality of spaced apart holes which are adapted to receive the spigot formation for relative rotational movement.

The frame may include a cross member adapted to provide a stop against which the first foot rest is adapted to bear when in one of its extreme positions.

Also according to the invention, there is provided a leg rest located substantially above the second foot rest in an operative position of the apparatus. Preferably the leg rest is adapted for movement between a folded position in which it rests against the retaining structure and an erected position in which it is located substantially above the second foot rest in an operative position of the apparatus.

DESCRIPTION

By way of example, preferred forms of the invention will now be described with reference to the accompanying examples:

Figure 1:
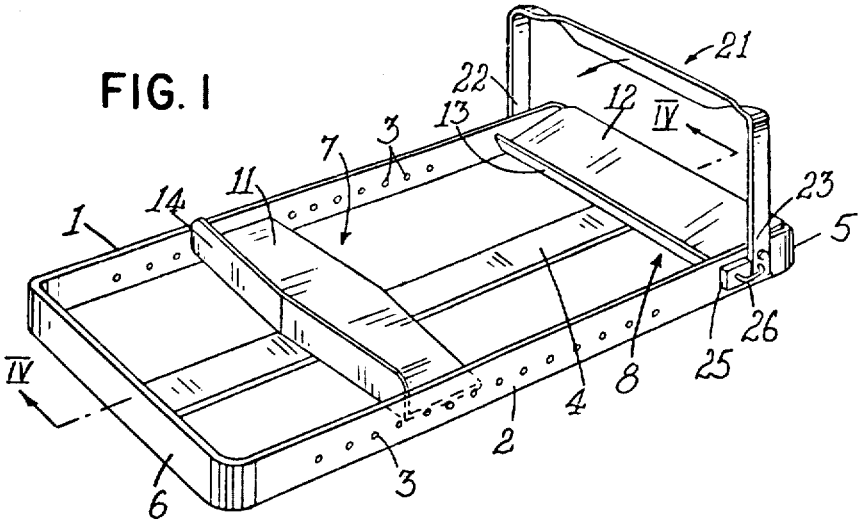
FIG. 1 is a projection of the apparatus.
Figure 2:
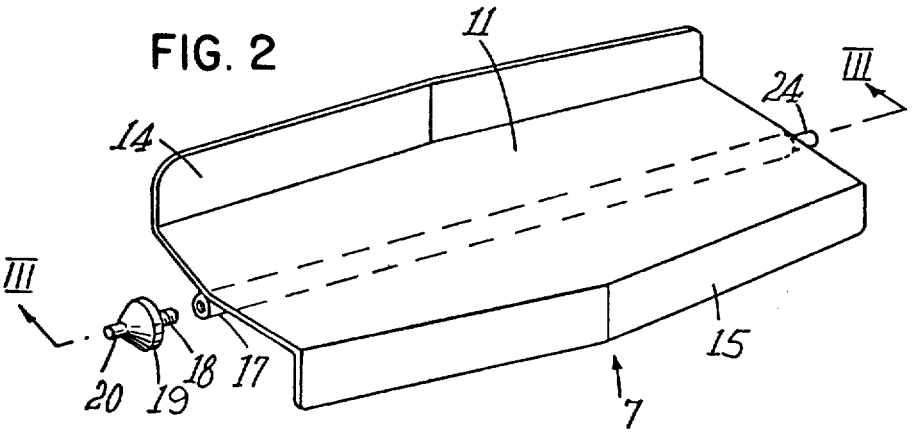
FIG. 2 is a projection of the first foot rest forming part of such apparatus.
Figure 3:
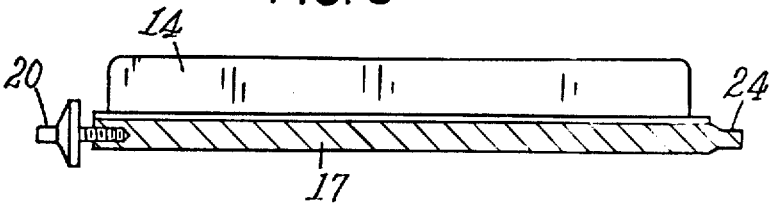
FIG. 3 is a section through the foot rest of FIG. 2 on the line III—III

The apparatus includes a retaining structure comprising a substantially rectangular open frame manufactured from a length of aluminium. Along two opposed sides 1 and 2 of the frame there are provided a plurality of holes 3 which are spaced apart at regular intervals along these sides, the holes on the one frame side 1 corresponding in position to the holes on the other frame side 2.

The retaining structure includes a cross member 4 which extends midway between the two opposed sides 1 and 2 along the length of the open frame and which has its free ends secured to the other two sides 5 and 6 of the rectangular frame.

The apparatus also includes two foot rests 7 and 8 which include shaped aluminium plates 9 and 10 providing foot supporting surfaces 11 and 12.

Foot rest 12 is permanently attached in position by securing the plate 10 in position to the sides 1, 2 and 5 of the frame and to the cross member 4. This foot rest is provided with an upturned flange 13 that acts to locate the foot of a person in position on the foot supporting surface 12 and to prevent the foot from slipping off this surface during use of the apparatus.

Foot rest 7 is provided with an upturned flange 14 that acts to locate the foot of a person in position on the foot supporting surface 11 and to prevent the foot from slipping off this surface during use of the apparatus. This foot rest is also provided with a dependent flange 15 that acts as a stop in one extreme position of the foot rest.

Foot rest 7 includes a rod 17 which is secured to the underside of the plate 9 to extend in a toe-to-heel line of the foot rest. One end of the rod 17 is tapped to receive a bolt having a threaded portion 18. The bolt is provided with a frusto-conical shaped head 19 having its tapered side converging away from the threaded end of the bolt and developing into a spigot formation 20. The other end of the rod is developed into a spigot formation 24.

The foot rest 7 is positioned in the frame by the locating sigot formations 20 and 24 opposite selected holes in the frame. The bolt is then unscrewed to move the spigot formations into the confines of the holes 3 and to bring the tapered sides of the bolt head 19 firmly into contact with the inner wall of the side 2. Removal of the foot rest from the frame is thus prevented.

The spigot formations 20,24 are therefore held for relative rotational movement by complementary shaped formations in the form of holes 3 provided at corresponding positions on the retaining structure for different spaced apart positions of one foot rest relative to the other foot rest.

As a result the foot rest 7 is free to rock relative to the retaining structure about the rod 17 in a toe-to-heel line of the foot rest 7.

Figure 4:
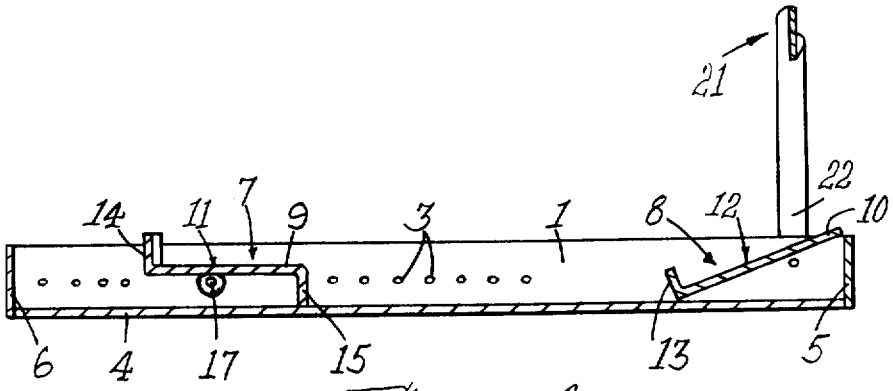
FIG. 4 is a section through the apparatus of FIG. 1 on the line IV—IV with the first foot rest shown in its one extreme position and a leg rest forming part of the apparatus in its erected position.

The extent of such rocking action is determined by the dependent flange 15 on the foot rest 7 and by the edge formed by the upturned flange 14 of the foot rest 7 bearing against cross member 4. The foot rest is therefore limited to a rocking movement between one extreme position in which the foot rest's supporting surface is substantially parallel to the plane containing the foot rests 7 and 8 as shown in FIG. 4 and another extreme position in which the foot supporting surface is inclined to the plane containing the foot rests and faces outwardly, relative to foot rest 8.

By locating the spigot formations in paired holes the foot rests face in substantially parallel directions while by locating the spigot formations in unpaired holes, the foot rests can be held in "-toe-in" or "toe-out" relative positions.

Figure 5:
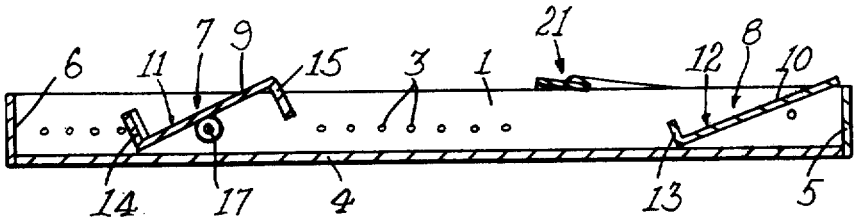
FIG. 5 is the section of FIG. 4 with the first foot rest shown in its other extreme position and the leg rest in its folded position.

The apparatus is also provided with a leg rest 21 which is substantially U-shaped and has its extremities 22 and 23 mounted to sides 1 and 2 respectively of the frame for pivotal movement between an erected position (see FIG. 4) in which the leg rest 21 is held by the retaining structure above the foot rest 8 and a folded position (see FIG. 5) in which it rests against the frame. The leg rest is adapted to be held in its erected position by means of a stop 25 and locking pin 26. In its erected position, the leg rest bears against an outside portion of a leg of a golfer and acts to restrict outward movement of the golfer's leg, relative to the foot rest 8, during use of the apparatus.

In use, the foot rest 7 is secured in position on the frame to locate the feet of a golfer in a desired spaced apart relationship. In the case of a "right-handed" golfer, the left foot is placed on foot rest 7 while the right foot is placed on foot rest 8. In this position the golfer addresses the ball correctly for the beginning of his swing. During playing the shot, leg rest 21 prevents the outward movement of the right leg during the back swing while the foot rest 7 allows the left foot to roll during the down swing thus enabling the player to transfer his weight from the right foot to the left foot and at the same time prevent the player from swaying to the left. Having got the feel of the stance dictated by the apparatus and having practiced hitting golf balls while maintaining the correct stance on the apparatus the golfer can now practice hitting balls without the use of the apparatus knowing at the same time the correct stance to adopt during playing a stroke.

In the case of a "left-handed" golfer, the right foot is placed on foot rest 7 while the left foot is placed on foot rest 8. In this case leg rest 21 prevents outward movement of the left leg while foot rest 7 allows the right foot to roll during the down swing.

Figure 6:
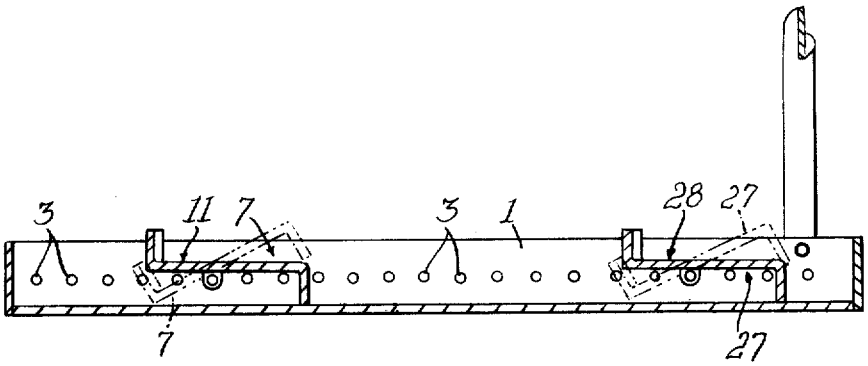
FIG. 6 is a section through a second form of the invention in which there is provided two footrests, each of which footrests is supported for movement between two extreme positions.

Although the invention has been described with reference to apparatus in which the footrest 7 is adapted to rock between two extreme positions and the footrest 8 is held fixed in position, it is conceivable that circumstances may require both footrests to rock between extreme positions. In this form of the invention, holes 3 are provided along the entire length of the opposed sides of the frame, only one of which sides is shown in FIG. 6 and indicated by numeral 1.

Instead of footrest 8 of the invention as shown in FIGS. 1 to 5, there is provided a second footrest 27 corresponding in all respects to the footrest 7 described above. Such footrest 27 is supported by the opposed sides of the frame in the same manner as described for footrest 7, to allow the footrest to rock between a first extreme position in which the footrest is shown in solid line in FIG. 6 to a second extreme position in which the footrest is shown in broken lines in FIG. 6. From FIG. 6 it will be seen that, in the first extreme position of the second footrest 27, the foot supporting surface 28 is substantially parallel to the foot supporting surface 11 of the first footrest 7 in the latter footrest's first position while in the second extreme position of the footrest 27, the foot supporting surface 28 is substantially parallel to the foot supporting surface 11 of the first footrest in the latter footrest's second extreme position.

The invention therefore provides apparatus which is simple to construct, can be constructed at low cost and which provides as effective means by which to train golfers.

I claim:

1. Apparatus for use in training golfers, comprising: a retaining structure; a first movable foot rest; a second foot rest; first means for movably supporting said first foot rest in said retaining structure; and second means for supporting said second foot rest in said retaining structure, said first and second foot rests being supported in a spaced apart arrangement, each foot rest having a foot supporting surface, the first foot rest being supported to rock, in an operative position of the apparatus, between a first extreme position in which its foot supporting surface is substantially horizontal and a second extreme position in which its foot supporting surface is inclined to the horizontal and faces outwardly relative to the second foot rest.

2. Apparatus as claimed in claim 1 in which the foot supporting surface of the second foot rest is substantially parallel to the foot supporting surface of the first foot rest in the second extreme position of the first foot rest.

3. Apparatus as claimed in claim 1 in which the first foot rest is provided with formations which are held, for relative rotational movement, by complementary shaped formations provided at corresponding positions on the retaining structure for different spaced apart positions of the first foot rest relative to the second foot rest, said first foot rest formations and said complementary shaped formations comprising said first means for supporting.

4. Apparatus as claimed in claim 1 including a leg rest held by the retaining structure above the second foot rest in a position in which it bears against an outside portion of a leg of the golfer during training of the golfer.

5. Apparatus as claimed in claim 1 in which the second means for supporting movably supports the second foot rest and in which the second foot rest is rockable between one extreme position in which its foot supporting surface is substantially parallel to the foot supporting surface of the first foot rest in the first extreme position of the first foot rest and a second extreme position in which its foot supporting surface is substantially parallel to the foot supporting surface of the first foot rest in the second extreme position of the first foot rest.

6. Apparatus as claimed in claim 5 in which the first foot rest is provided with formations which are held, for relative rotational movements, by complementary shaped formations provided at corresponding positions on the retaining structure for different spaced-apart positions of the first foot rest relative to the second foot rest, said first foot rest formations and said complementary shaped formations comprising said first means for supporting.

7. Apparatus as claimed in claim 5 including a leg rest held by the retaining structure above the second foot rest in a position in which it bears against the outside portion of a leg of the golfer during training of the golfer.

8. Apparatus for use in training golfers, comprising: a retaining structure; first and second foot rests which each have a foot supporting surface, the first foot rest including formations which are held, for relative rotational movement, by complementary shaped formations provided at corresponding positions on the retaining structure for different spaced-apart positions of the first foot rest relative to the second foot rest, the first foot rest including restraining means and being restrained, in an operative position of the apparatus, to rock between one extreme position in which its foot supporting surface is substantially horizontal and a second extreme position in which its foot supporting surface is inclined to the horizontal and faces outwardly relative to the second foot rest, the second foot rest having the foot supporting surface located substantially parallel to the foot supporting surface of the first foot rest in the second extreme position of the first foot rest; and a leg rest held by the retaining structure above the second foot rest in a position in which it is bearable against an outside portion of a leg of the golfer during training of the golfer.

9. Apparatus for use in training golfers, comprising: a retaining structure; first and second foot rests which each have a foot supporting surface, the first foot rest including formations which are held, for relative rotational movement, by complementary shaped formations provided at corresponding positions on the retaining structure for different spaced-apart positions of the first foot rest relative to the second foot rest, the first foot rest including restraining means and being restrained, in an operative position of the apparatus, to rock between a first extreme position in which its foot supporting surface is substantially horizontal and a second extreme position in which its foot supporting surface is inclined to the horizontal and faces outwardly relative to the second foot rest, the second foot rest being rockable between one extreme position in which its foot supporting surface is substantially parallel to the foot supporting surface of the first foot rest in the first extreme position of the first foot rest and a second extreme position in which its foot supporting surface is substantially parallel to the foot supporting surface of the first foot rest in the second extreme position of the first foot rest; a leg rest; and means for holding the leg rest in the retaining structure above the second foot rest in a position in which it bears against an outside portion of a leg of the golfer during training of the golfer.

* * * * *